US008436282B2

(12) United States Patent
Tuszkiewicz et al.

(10) Patent No.: US 8,436,282 B2
(45) **Date of Patent: *May 7, 2013**

(54) MICROWAVABLE CONTAINER WITH SLEEVE

(75) Inventors: George A. Tuszkiewicz, Plymouth, MN (US); Richard L. Mace, Seneca, IL (US)

(73) Assignee: General Mills, Inc., Minneapolis, MN (US)

( * ) Notice: Subject to any disclaimer, the term of this patent is extended or adjusted under 35 U.S.C. 154(b) by 265 days.

This patent is subject to a terminal disclaimer.

(21) Appl. No.: 12/731,878

(22) Filed: Mar. 25, 2010

(65) Prior Publication Data

US 2010/0176122 A1 Jul. 15, 2010

Related U.S. Application Data

(60) Continuation of application No. 12/331,877, filed on Dec. 10, 2008, which is a division of application No. 11/404,576, filed on Apr. 14, 2006, now Pat. No. 7, 468,498, which is a continuation-in-part of application No. 11/334,808, filed on Jan. 18, 2006, now abandoned.

(60) Provisional application No. 60/646,093, filed on Jan. 21, 2005.

(51) Int. Cl.
*H05B 6/80* (2006.01)
*B65D 65/00* (2006.01)

(52) U.S. Cl.
USPC ..... 219/725; 219/732; 99/451; 426/234; 426/243; 229/902; 220/258.5

(58) Field of Classification Search ..... 219/725–735, 219/762; 99/DIG. 14, 450, 451, 475; 426/107, 426/113, 118, 234, 241–243; 229/902, 904; 220/258.5, 361, 4.21, 212; 206/343, 152, 206/153, 158
See application file for complete search history.

(56) References Cited

U.S. PATENT DOCUMENTS

| | | | | |
|---|---|---|---|---|
| 3,142,378 | A * | 7/1964 | Lengsfield, Jr. | 206/192 |
| 4,416,906 | A | 11/1983 | Watkins | |
| 4,486,640 | A | 12/1984 | Bowen et al. | |
| 4,560,850 | A | 12/1985 | Levendusky et al. | |
| 4,570,795 | A | 2/1986 | Fernandez Sanz | |
| 4,640,838 | A | 2/1987 | Isakson et al. | |
| 4,704,510 | A | 11/1987 | Matsui | |
| 4,828,112 | A * | 5/1989 | Vollrath et al. | 206/519 |
| 5,266,763 | A | 11/1993 | Colombo | |
| 5,429,239 | A * | 7/1995 | Baxter | 206/434 |
| 6,298,992 | B1 | 10/2001 | Tsao | |

(Continued)

*Primary Examiner* — Quang Van
(74) *Attorney, Agent, or Firm* — Annette M. Frawley; Kyle T. Peterson; Daidre L. Burgess

(57) ABSTRACT

A food package kit including a plurality of trays having a bottom, a sidewall extending upwardly from the bottom and terminating at a top end, and a flange extending from the sidewall opposite the bottom, the flange includes a rim section configured to receive a sealing film, and a recessed section extending from the rim section, wherein each of the opposed longitudinal edges intersect with a lateral edge at a corner, wherein the kit also includes a sleeve adapted to contain the trays completely therein, the sleeve including a sleeve top, a first depending sleeve side, and a second depending sleeve side and a sleeve bottom, wherein the tray is completely disposed within the sleeve by frictional force between the tray and the sleeve.

13 Claims, 16 Drawing Sheets

U.S. PATENT DOCUMENTS

| | | | | |
|---|---|---|---|---|
| 6,390,299 | B1 | 5/2002 | Mellon et al. | |
| 6,390,795 | B1 | 5/2002 | Waring | |
| 6,559,431 | B2 * | 5/2003 | Hopkins | 219/735 |
| 6,615,985 | B1 | 9/2003 | Foreman | |
| 6,672,473 | B2 | 1/2004 | Torniainen et al. | |
| 7,468,498 | B2 * | 12/2008 | Tuszkiewicz et al. | 219/725 |
| 7,671,308 | B2 | 3/2010 | Kreisman et al. | |
| 2004/0035867 | A1 * | 2/2004 | Schultz et al. | 220/212 |
| 2006/0191935 | A1 | 8/2006 | Tuszkiewicz et al. | |
| 2009/0081336 | A1 | 3/2009 | Tuszkiewicz | |

* cited by examiner

MICROWAVABLE CONTAINER WITH SLEEVE

RELATED APPLICATIONS

This application is a continuation of application Ser. No. 12/331,877, filed Dec. 10, 2008, which in turn is a division of application Ser. No. 11/404,576, filed Apr. 14, 2006, which in turn is a continuation-in-part of application Ser. No. 11/334,808, filed Jan. 18, 2006, which claims the benefit of U.S. Provisional Application No. 60/646,093, filed Jan. 21, 2005, each of which is hereby fully incorporated herein by reference.

FIELD OF THE INVENTION

The invention relates generally to the packaging of edible products. More particularly, the invention relates to a packaging assembly adapted for microwave oven cooking that reduces material requirements, optimizes space, and facilitates handling of the microwavable container by the consumer when the contents of the container are hot.

BACKGROUND OF THE INVENTION

Consumers often prefer to cook food in a microwave oven rather than conventional ovens because of the reduced cooking time required to heat foods in a microwave oven. As a result, a wide variety of food items have been designed for heating in a microwave oven. Popular examples of these items include lasagna, cheese macaroni dishes and vegetable casseroles.

Microwave ovens do not transfer heat to a material in the same manner as conventional ovens. Rather, the material is induced to heat itself as the microwave oven generates a continually changing electrical field. Accordingly, microwave cooking requires containers that are transparent to microwave energy.

A variety of trays and containers have been developed specifically for microwave heating. For example, Matsui U.S. Pat. No. 4,704,510 discloses a container for food service which is adapted to withstand heating in a microwave oven. The container is formed from a laminate sheet material consisting of a non-stretched polyethylene terephthalate film laminated to the interior of a foamed plastic sheet. The bottom of the container is raised to curve concavely towards the center thereof to distribute the container contents and improve upon the heat distribution within the container during the heating or cooking of the contents with microwave radiation. However, the laminated container material utilized is relatively expensive to construct.

Bowen et al. U.S. Pat. No. 4,486,640 relates to a utensil for cooking and/or baking foods in a microwave oven in which a generally flat-bottomed container base incorporates a removable tray and a closure lid possessing apertures to enable the escape of steam which is generated during cooking. This microwaveable container structure is relatively complex and expensive, while not facilitating the optimum distribution of foods or comestibles within the container to allow for a more uniform temperature distribution therethrough during cooking with microwave energy.

Watkins U.S. Pat. No. 4,416,906 discloses a microwave food heating container having a central raised core in the container bottom to essentially distribute the food contained therein about an annulus to improve upon the uniform heating thereof. As in the other above-mentioned patents, there is no optimum distribution of the food within the container so as to allow for a greater efficiency during cooking and a degree in the uniformity of the temperature which will meet the demands of the technology for cooking with microwave energy.

Isakson et al. U.S. Pat. No. 4,640,838 describes a vapor-tight microwave oven package incorporating a vent enabling the escape of steam or vapor which is generated during cooking, and does not provide for an optimum distribution of foods within a generally rigid microwaveable container to attain uniform temperatures during microwave cooking or heating of the food contents of a container.

Levendusky et al. U.S. Pat. No. 4,560,850 discloses a microwave container with a cover incorporating a port for the release of steam, and with a raised container bottom to distribute the foods therein for more even cooking or heating. This structure also fails to provide for the optimum dispersion of a food within a specially configured container and does not allow for an adequately uniform temperature distribution through the food as it is cooked by microwave energy with a resultant higher degree of efficiency.

Although various measures have been undertaken to improve upon efficiency and temperature uniformity of microwave cooking, they have not proven to be entirely adequate, especially when used for prepackaged, single-serve applications. Many single-serve microwavable trays are relatively flimsy, making it difficult for a consumer to remove a tray containing hot items from the microwave without experiencing some discomfort. Moreover, many prior art trays require expensive container constructions.

Single-serve containers often require specially designed wrappers or packaging cartons to display nutritional information, ingredients, and heating instructions. These wrappers and packaging cartons can become destroyed or separated from the carton upon use, requiring separate packaging materials and instructions for each microwave serving. This extraneous packaging material increases the cost to the consumer. Prior art trays also incorporate inefficient designs which do not adequately utilize the retail shelf space or the volume of the shipping cube.

SUMMARY OF THE INVENTION

In view of the shortcomings set forth above, it is an object of the invention to provide an improved microwave food package, which minimizes material requirements, locks multiple containers in a paperboard sleeve, and optimizes the shipping cube and retail shelf space. It is also an object of the invention to facilitate removal of the tray from the microwave when the tray contains hot materials.

The invention includes a container for use in microwave heating. The container includes a bottom, a sidewall extending upwardly from the bottom and terminating at a top end, and a flange extending from the sidewall opposite the bottom. The flange includes a rim section configured to receive a sealing film and a recessed section including a plurality of handles. A pair of catch members are located between the plurality of handles. The catch members extend radially outwardly on opposed sides of the container.

In another embodiment, the invention includes a food package assembly comprising a first tray including a bottom, a sidewall extending upwardly from the bottom and terminating at a top end and a flange extending from the sidewall opposite the bottom. The flange includes a rim section configured to receive a sealing film and a recessed section extending from the rim section. The recessed section terminates in a pair of opposed lateral edges and a pair of opposed longitudinal edges, wherein each of the opposed longitudinal edges intersect with a lateral edge at a corner, wherein each corner contains a handle. An outwardly extending catch member is disposed between the handles on each of the lateral edges. A sealing film is attached to the rim section. A sleeve for holding the tray including a sleeve top and a sleeve base. The sleeve base contains an aperture having a port, wherein the catch member is disposed through the port.

Yet another aspect of the invention includes a method of preparing food for subsequent sale. The method includes the steps of providing a container including a bottom, a sidewall extending upwardly from the bottom and terminating at a top end, the sidewall defining an interior, and a flange extending from the sidewall opposite the bottom. The flange includes a rim section configured to receive a sealing film, and a recessed section extending from the rim section. The recessed section terminates in a pair of opposed lateral edges and a pair of opposed longitudinal edges, wherein each of the opposed longitudinal edges intersect with a lateral edge at a corner, wherein each corner contains a handle. A catch member is disposed on each of the lateral edges, between the handles. The method also includes the steps of positioning food in the interior of the container, attaching a sealing film to the rim section, providing the sleeve including a sleeve top and a sleeve base, wherein the sleeve base contains an aperture having a port and placing the tray in the sleeve so that the catch member is at least partially disposed through the port.

In a preferred embodiment, the invention includes a food package kit including a plurality of trays having a bottom, a sidewall extending upwardly from the bottom and terminating at a top end, and a flange extending from the sidewall opposite the bottom. The flange includes a rim section configured to receive a sealing film and a recessed section extending from the rim section. The recessed section terminates in a pair of opposed lateral edges and a pair of opposed longitudinal edges, wherein each of the opposed longitudinal edges intersect with a lateral edge at a corner, and each corner contains a handle. The trays also include an outwardly extending catch member disposed between the handles on each of the lateral edges. Sealing film is adapted to be attached to the rim section. The kit also includes a sleeve adapted to contain the trays completely therein. The sleeve includes a sleeve top, a first depending sleeve side, a second depending sleeve side and a sleeve bottom, wherein the tray is completely disposed within the sleeve by frictional force between the tray and the sleeve.

In another alternative embodiment, the invention includes a food package kit having a first tray and a second tray. Both the first tray and the second tray include a bottom, a sidewall extending upwardly from the bottom and terminating at a top end, and a flange extending from the sidewall opposite the bottom. The flange includes a rim section configured to receive a sealing film and a recessed section extending from the rim section. The recessed section terminates in a pair of opposed lateral edges and a pair of opposed longitudinal edges. Each of the opposed longitudinal edges intersect with a lateral edge at a corner, wherein each corner contains a handle. An outwardly extending catch member is disposed between the handles on each of the lateral edges. A sealing film is adapted to be attached to the rim section. The kit also includes a sleeve adapted to hold the first tray and the second tray completely therein using only frictional force. The sleeve includes a sleeve top, a first depending sleeve side, a second depending sleeve side and a sleeve bottom. The first tray and the second tray are disposed within the sleeve by frictional force between the first tray, the second tray, and the sleeve.

In yet another alternative embodiment, the invention includes a method of preparing food for subsequent sale. The method includes the steps of providing a container having a bottom, a sidewall extending upwardly from the bottom and terminating at a top end, the sidewall defining an interior and a flange extends from the sidewall opposite the bottom. The flange includes a rim section configured to receive a sealing film and a recessed section extending from the rim section. The recessed section terminates in a pair of opposed lateral edges and a pair of opposed longitudinal edges. Each of the opposed longitudinal edges intersect with a lateral edge at a corner and each corner contains a handle. A catch member is disposed on each of the lateral edges, between the handles. The method also includes the steps of dispensing food in the interior of the container, attaching a sealing film to the rim section, providing a sleeve including a sleeve top, a first depending sleeve side, a second depending sleeve side and a sleeve base. In accordance with the method, the tray or a plurality of trays are placed completely within the sleeve so that frictional force between the tray and the sleeve keeps the tray or trays inside the sleeve.

BRIEF DESCRIPTION OF THE DRAWINGS

The invention may be more completely understood in consideration of the following detailed description of various embodiments of the invention in connection with the accompanying drawings, in which.

Figure 1:
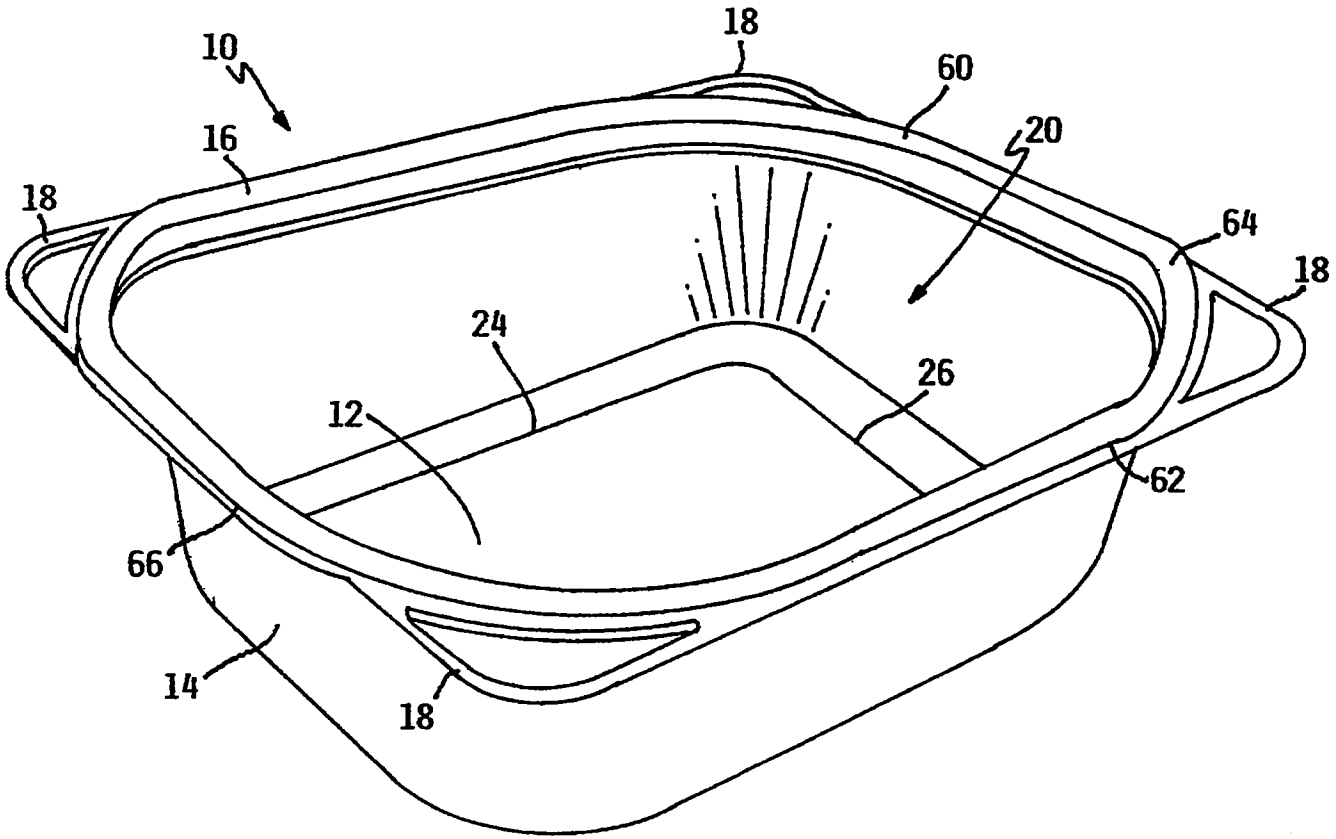
FIG. 1 shows an isometric view of a microwaveable container pursuant to the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

A microwavable food container 10 in accordance with the invention is shown in FIG. 1. Container 10 is generally defined by a bottom 12, a sidewall 14, a flange 16 and handles 18. Container 10 is an integrally thermoformed plastic material, such as polyolefins (e.g., polypropylene, polyethylene), blends of polyolefins, polystyrene—HIPS, or polyester resin-based materials—CPET, foamed polypropylene, polyethylene), blends of polyolefin's polystyrene—HIPS, or polyester resin-based materials—CPET, paper and paper laminations with polypropylene, polyester, etc. In an alternative embodiment, container 10 may be fabricated using known injection molding or compression molding techniques. Sidewall 14 extends upwardly from bottom 12, defining an interior 20 for containing a food item (not shown). Flange 16 extends radially outwardly and downwardly relative to a top of sidewall 14.

Handles 18 extend from the corners of flange 16. Sidewall 14 and flange 16 are uniquely configured to provide torsional support when container 10 is lifted. Container 10 can incorporate different wall thicknesses. In one embodiment, container 10 has a wall thickness from about 0.02 to about 0.05 inches.

Throughout this specification, directional terminology, such as "top," "bottom," "upwardly," "downwardly," "above," "below," etc. is used with reference to the preferred upright orientation of container 10 in FIG. 1. However, container 10 can be positioned in a wide variety of different orientations, such that the directional terminology does not limit the invention.

Figure 2:
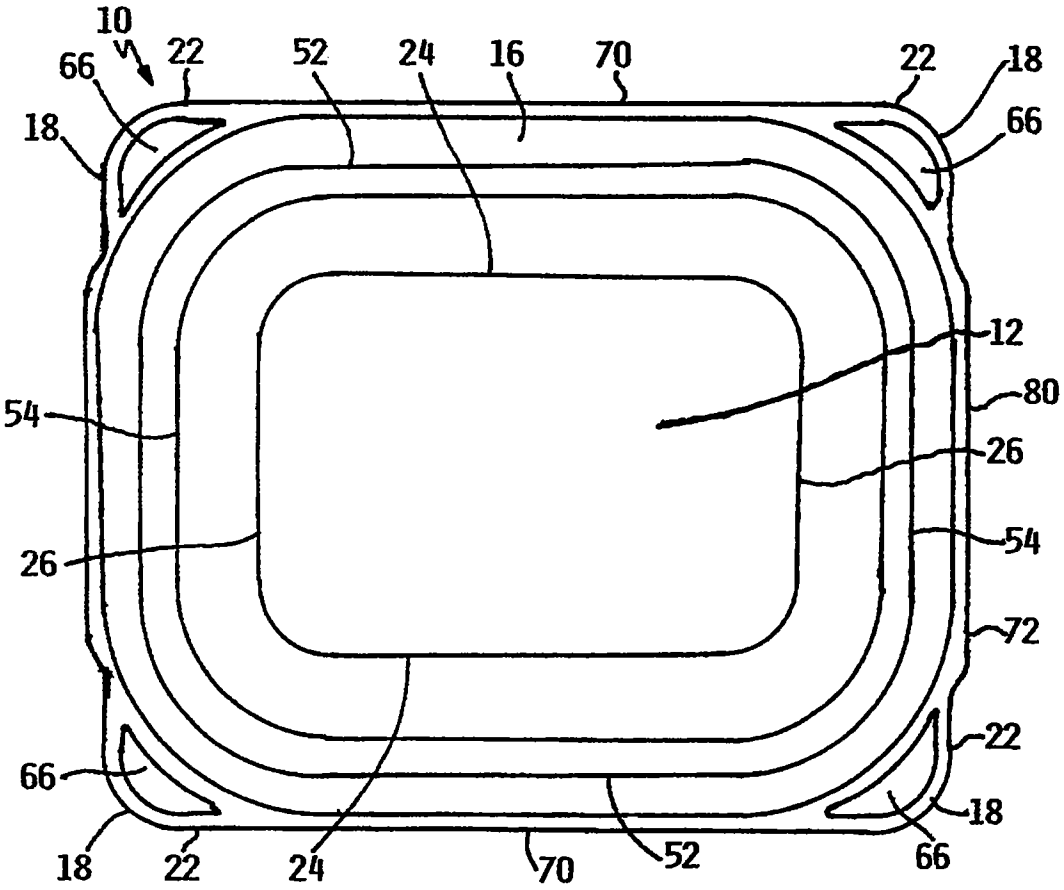
FIG. 2 shows a top plan view of a microwaveable container pursuant to the invention.

With reference to FIG. 2, bottom 12 in this embodiment is generally rectangular in shape, defining four rounded corners 22. Alternatively, a variety of other shapes are acceptable, including circular, oval, square, etc. In one embodiment, bottom 12 is rectangular. In alternative embodiments, bottom 12 can be oval or circular. A rectangular flange 16 configuration is useful for maximizing the cubic capacity of the container, shipping crate, warehouse space and retail space.

Bottom 12 defines opposing longitudinal sides 24 and opposing lateral sides 26, as best shown in the top plan view of FIG. 2. The longitudinal sides 24 and lateral sides 26 may be flat or curved relative to a central axis of container 10.

Figure 3:
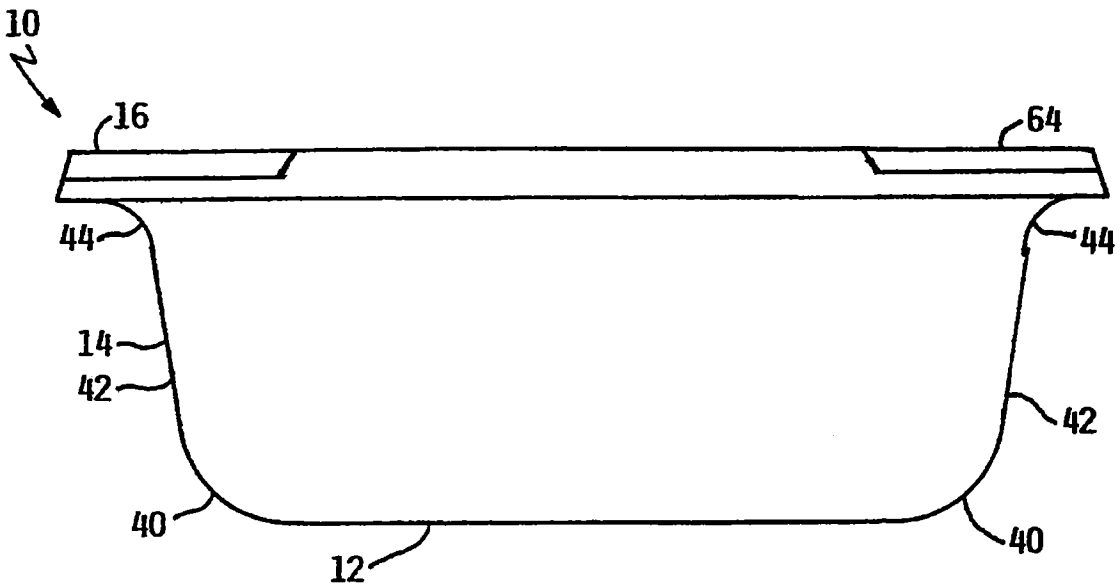
FIG. 3 shows a side elevational view of the microwaveable container pursuant to the invention.
Figure 4:
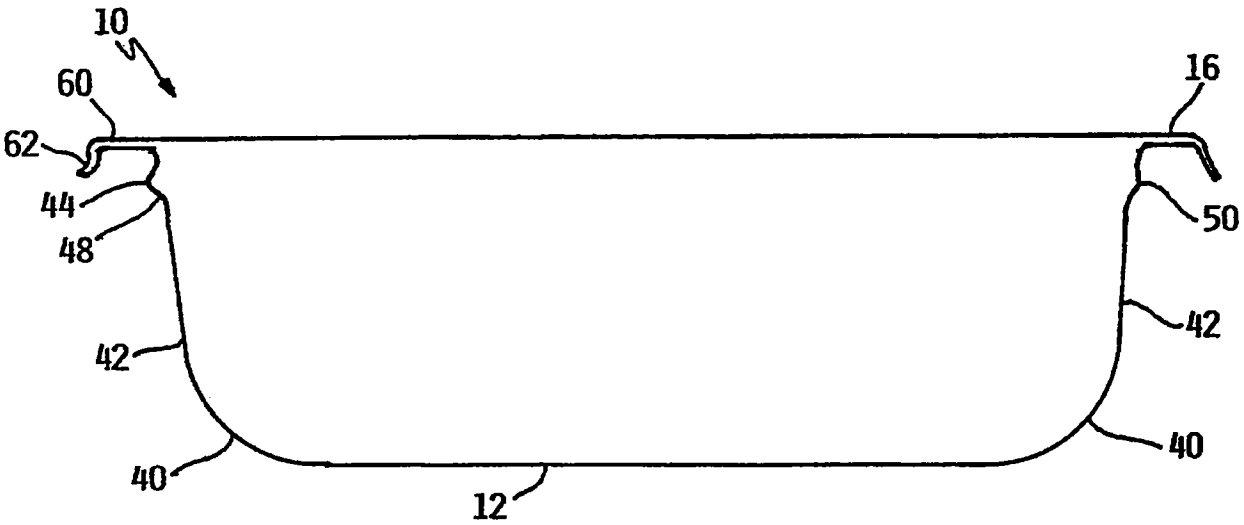
FIG. 4 shows a cross sectional front elevational view of the microwaveable container pursuant to the invention.

As shown in FIGS. 3 and 4, bottom 12 is generally flat. A flat bottom 12 promotes stable placement of the container 10 on a table top, in a microwave oven or on another flat surface.

In an alternative embodiment, bottom 12 may be concaved upwardly or inwardly relative to interior 20 to enhance microwave interaction with food items contained within container 10. In yet another embodiment, bottom 12 may include a load bearing surface around the perimeter of bottom 12. This configuration promotes the overall stability of the container.

Sidewall 14 is continuous, extending from bottom 12. In this regard, sidewall 14 is defined by a base section 40, an intermediate section 42 and an upper section 44. Base section 40 extends from bottom 12. Intermediate section 42 extends between base section 40 and upper section 44. Finally, upper section 44 terminates in flange 16.

Base section 40 extends radially outwardly and upwardly from bottom 12. In particular, base section 40 is curved in transverse cross-section (or "transversely curved"). With respect to the central axis of container 10, base section 40 forms a convex curve. Moreover, base section 40 defines a transverse, cross-sectional radius in the range of from about 0.25 to about 1.0 inch. However, a radius in the range of from about 0.4 to about 0.6 inch promotes the overall stability and torsional resistance of container 10.

Intermediate section 42 extends generally upwardly from base section 40, and is linear in transverse cross-section. As shown in FIGS. 3 and 4, however, intermediate section 42 forms a slight radial projection outward from bottom to top. Accordingly, intermediate section 42 tapers inwardly relative to the central axis in transverse cross-section. Thus, a transverse cross-sectional length and width of container 10 along intermediate section 42 is greater at a top portion thereof as compared to adjacent base section 40. The radial projection of intermediate section 42 defines an angle relative to a horizontal plane in the range of from about 70 to about 89 degrees.

Finally, upper section 44 extends from intermediate section 42, and defines a collar 48 and a stacking wall 50. Collar 48 extends radially outwardly from intermediate section 42. Stacking wall 50, in turn, extends generally upwardly from collar 48 and terminates at flange 16. In one embodiment, stacking wall 50 defines, in transverse cross-section, a slight inward taper from bottom to top, relative to the central axis. With this configuration, upper section 44 promotes stacking of another, similarly formed container (not shown) within container 10, but prevents the second container from entirely nesting within container 10, with collar 48 of the second container resting on flange 16. If the second container were allowed to fully nest within container 10, frictional forces would prevent easy disassembly of the second container from container 10.

An additional feature of sidewall 14 is best illustrated by the longitudinal or top plan cross-sectional view of FIG. 2, where the flange 16 is illustrated as preferably defining opposing longitudinal sides 52 and opposing lateral sides 54. Sides 52, 54 correspond with sides 24, 26 of bottom 12 as previously described.

With reference to FIG. 1, flange 16 extends from sidewall 14, and is generally defined by a rim section 60 and a recessed section 62. As best shown by FIG. 3, the rim section 60 extends radially outwardly from upper section 44 of sidewall 14 terminating at edge 66, providing an outer surface 64. Rim section 60 of the invention forms a relatively flat outer surface 64, which is useful for receiving a sealing film (not shown) that is otherwise utilized to seal a food item (not shown) within container 10.

Recessed section 62 extends from edge 66 of rim section 60 opposite sidewall 14. As depicted in FIGS. 3 and 4, recessed section 62 extends around the exterior of container 10, generally downwardly relative to rim section 60, and radially outward relative to sidewall 14. The location of recessed section 62 where longitudinal sides 52 meet lateral sides 54 defines multiple corners 22 of container 10. Each corner 22 includes a handle 18. Handles 18 extend radially outward from sidewall 14 and include grips 66. Grips 66 are generally located in a plane that is parallel to but lower than the outer surface 64 of flange 16. This aspect of the invention has been found to enhance the overall stability of the container.

Recessed section 62 preferably extends an appreciable distance downwardly relative to outer surface 64 of rim section 60. In one embodiment, recessed section 62 of the invention has a downward extension (relative to the outer surface 64) in the range of from about 0.1 to about 0.2 inch. It is believed that this relatively small downward extension, within the critical range, contributes to overall stability of container 10 while reducing the amount of space required to store nested empty containers 10 and full packaged containers 10.

Flange 16 provides a relatively large spacing between recessed section 62 and sidewall 14, thereby dissipating the amount of heat transferred from sidewall 14 to recessed section 62 that might otherwise be touched by a user, while not noticeably increasing manufacturing costs. For example, when container 10 containing a food substrate was heated for 2 minutes using a 1000 watt microwave oven, the temperature of sidewall 14 was found to be about 140° F. (60° C.). The temperature of flange 16 was about 100° F. (38° C.). However, the temperature of the grips 66 was less than 100° F. (38° C.), enabling a person to remove container 10 safely from the microwave oven.

An additional feature of flange 16 is best illustrated by the longitudinal or top plan view of FIG. 2. Flange 16 is shown as preferably defining opposing longitudinal edges 70 and opposing lateral edges 72. Edges 70, 72 correspond with sides 52, 54 of sidewall 14 previously described. Longitudinal edges 70 are located between corners 22 forming a generally linear edge of container 10. In contrast, lateral edges 72 include catch members 80 between corners 22 that extend radially outwardly past corners 22 to create a non-linear lateral edge 72.

With reference back to FIG. 1, and with additional reference to FIG. 2, handles 18 are formed as integral extensions of flange 16. In one preferred embodiment, handles 18 each define a radial extension from flange 16 of from about 0.3 to about 0.5 inch.

Both of flange 16 and collar 48 define compound curves as previously described. This characteristic has been found to provide container 10 with an elevated level of torque resistance when a lifting force is applied at a single point along corners 22. Following heating, container 10 is preferably lifted by a user (not shown) via handles 18. In the event the user inadvertently lifts container 10 with a single hand, grasping a handle 18 at one of corners 22, the compound curvature nature of flange 16 and collar 48 resist deflection or bending of the container 10 due to a weight of the contained food item (not shown).

Figure 5:
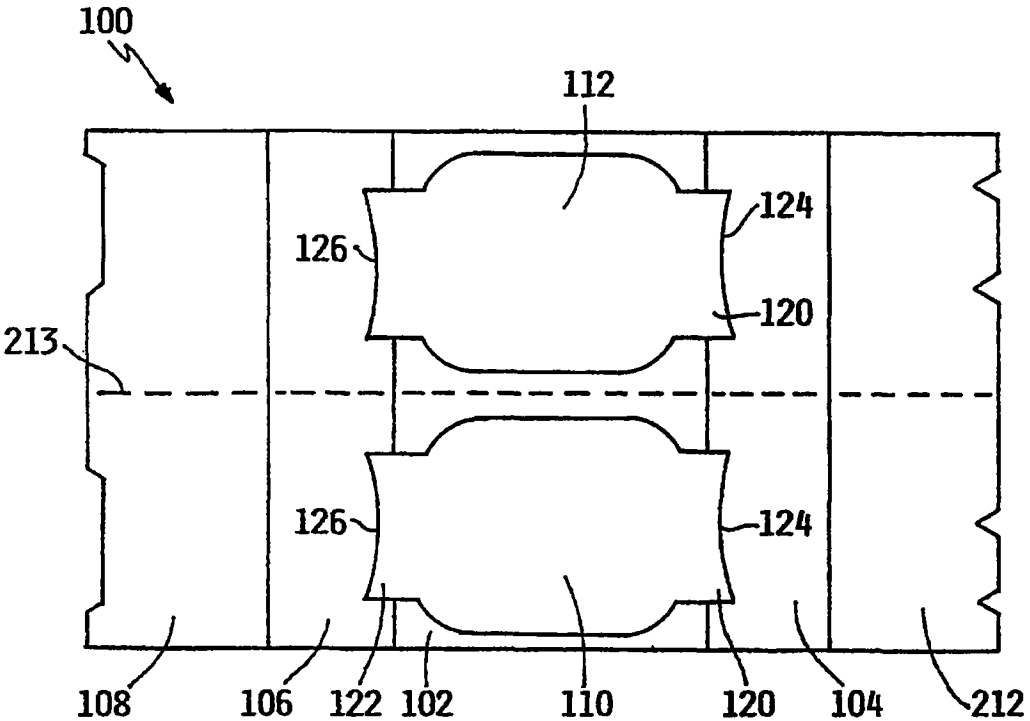
FIG. 5 shows a top plan view of a packaging sleeve pursuant to the invention.

With reference to FIG. 5, sleeve 100 and the shape of packaging sleeve 100 will now be discussed. Sleeve 100 is a box-shaped container made of paperboard or a similar paper product. Sleeve 100 includes a sleeve base 102, two depending sleeve sides 104, 106, a sleeve top 108, and a second sleeve top 212. Apertures 110 and 112 are disposed in base 102 of sleeve 100, although it will be appreciated that any number of apertures may be disposed in base 102 while remaining within the scope of the invention. Perforation 213 is shown along a central axis of sleeve 100.

Figure 6:
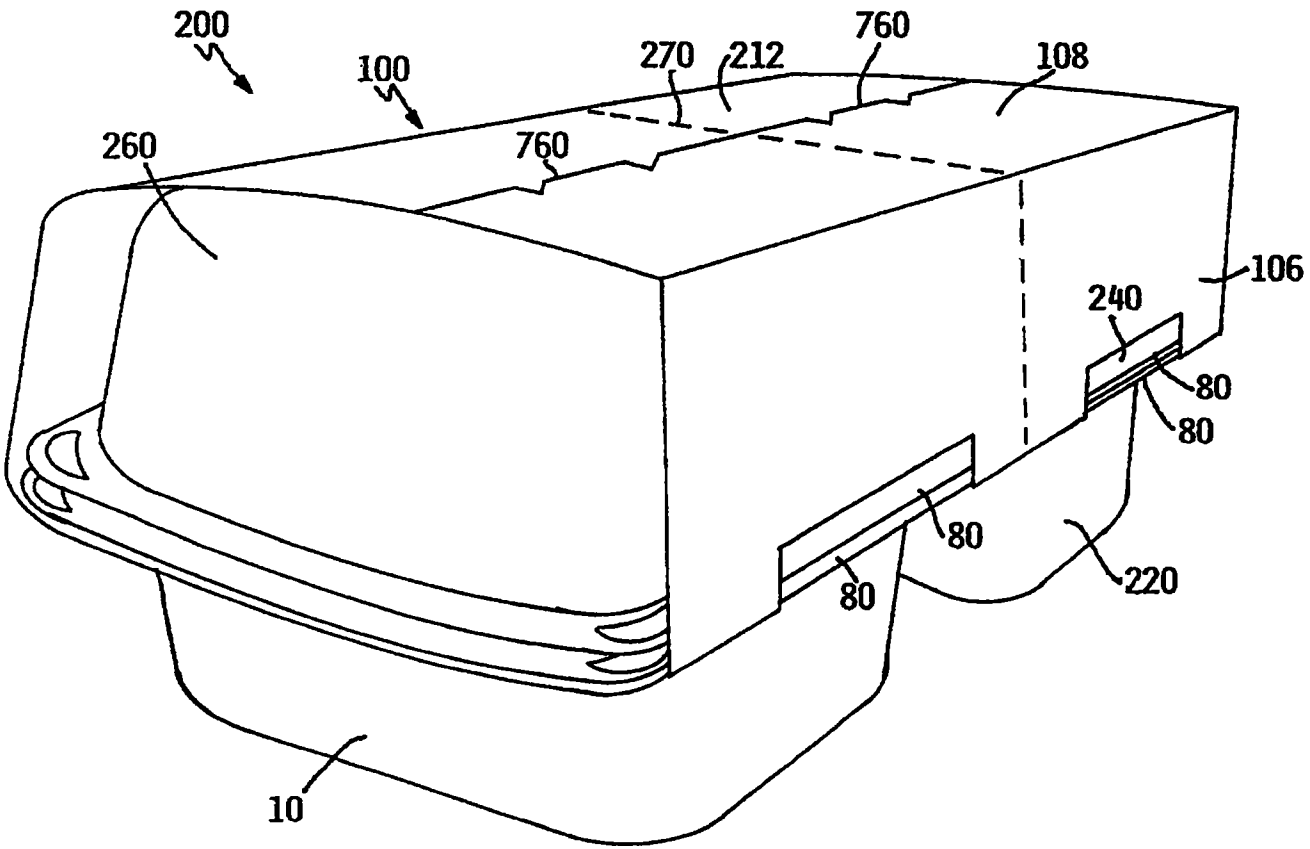
FIG. 6 shows an isometric view of the packaging assembly pursuant to the invention.

Sleeve 100 is designed to hold one or more containers 10 firmly in place within sleeve 100 to form a sleeve assembly 200 as shown in FIG. 6. In one embodiment, sleeve 100 is designed to hold four separate containers 10, 220, 240, and 260. Containers 220, 240, and 260 are substantially similar to container 10 in size and configuration. Container 240 is shown on top of container 220, while container 260 is shown on top of container 10. Containers 240 and 260 are shown upside-down on top of containers 220 and 10, respectively, so that flanges 16 of the containers rest against one another. However, containers 240 and 260 may be located in an upright configuration while remaining within the scope of the invention.

With reference to FIGS. 5 and 6, apertures 110 and 112 are primarily disposed through base 102. However apertures 110 and 112 also extend onto side 104 and side 106. The portion of apertures 110 or 112 that extends onto side 104 is a first port 120. The portion of apertures 110 or 112 that extends onto side 106 is a second port 122. Ports 120 contain surface 124 on side 104. Surface 124 is disposed of a convex curvature. This convex curvature facilitates the locking of container 10 in sleeve 100 as surface 124 interferes with the underside of catch members 80. However surface 124 may be disposed of a concave curvature or linear profile while remaining within the scope of the invention.

Figure 7:
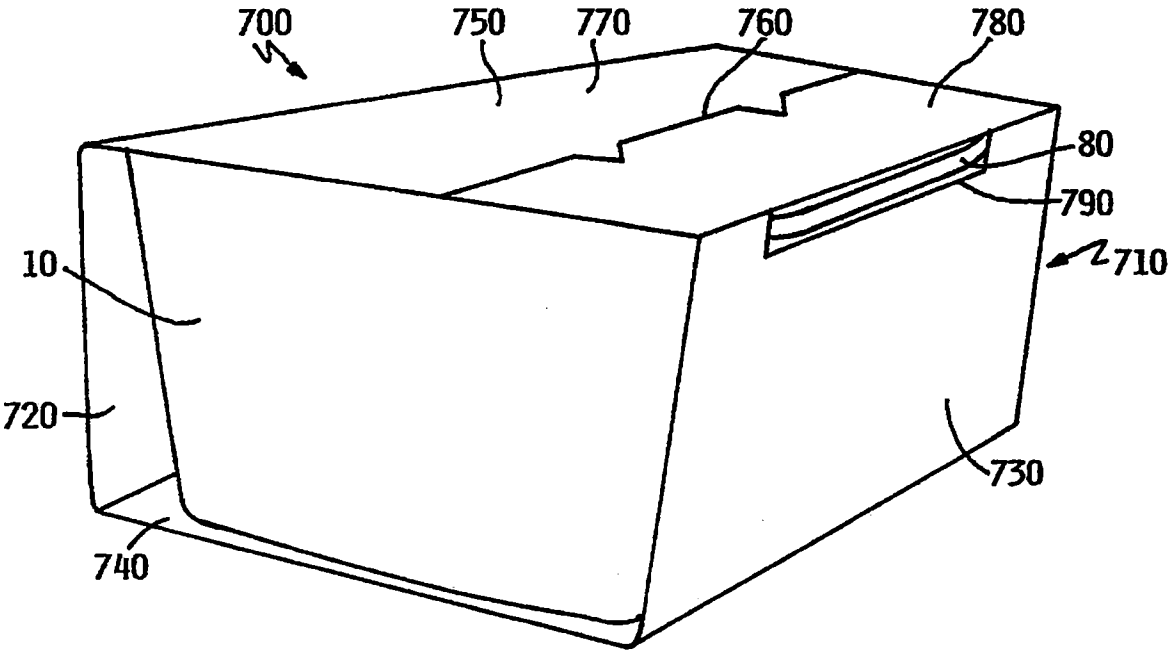
FIG. 7 shows an isometric view of a single tray packaging assembly pursuant to the invention.

FIG. 7 shows a single-tray assembly 700. Assembly 700 includes container 10 and sleeve 710. Sleeve 710 includes a first side 720, a second side 730, a bottom, 740, and a top 750. Top 750 includes an easy open and re-close partition 760. Partition 760 separates top 750 into a first side 770 and a second side 780 during removal of container 10 from sleeve 710. In a preferred embodiment, first side 770 overlaps second side 780 at partition 760. The die cut tab profile of partition 760 enables first side 720 to become interlocked with second side 730. Catch member 80 is shown extending through port 790 in side 730. Partition 760 may be included on a variety of sleeve configurations while remaining within the scope of the invention.

Figure 8:
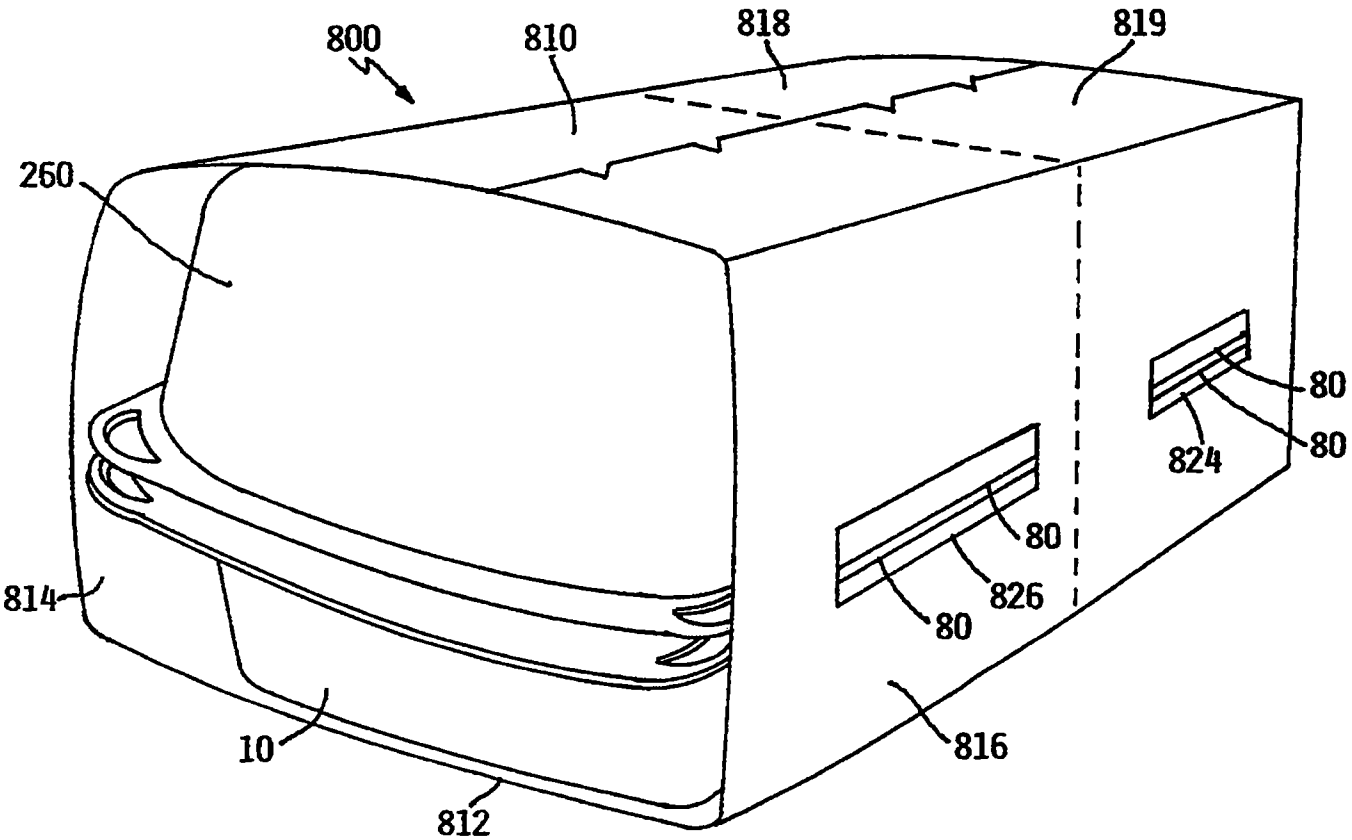
FIG. 8 shows an isometric view of the packaging assembly pursuant to the invention incorporating a full overwrap sleeve.
Figure 9:
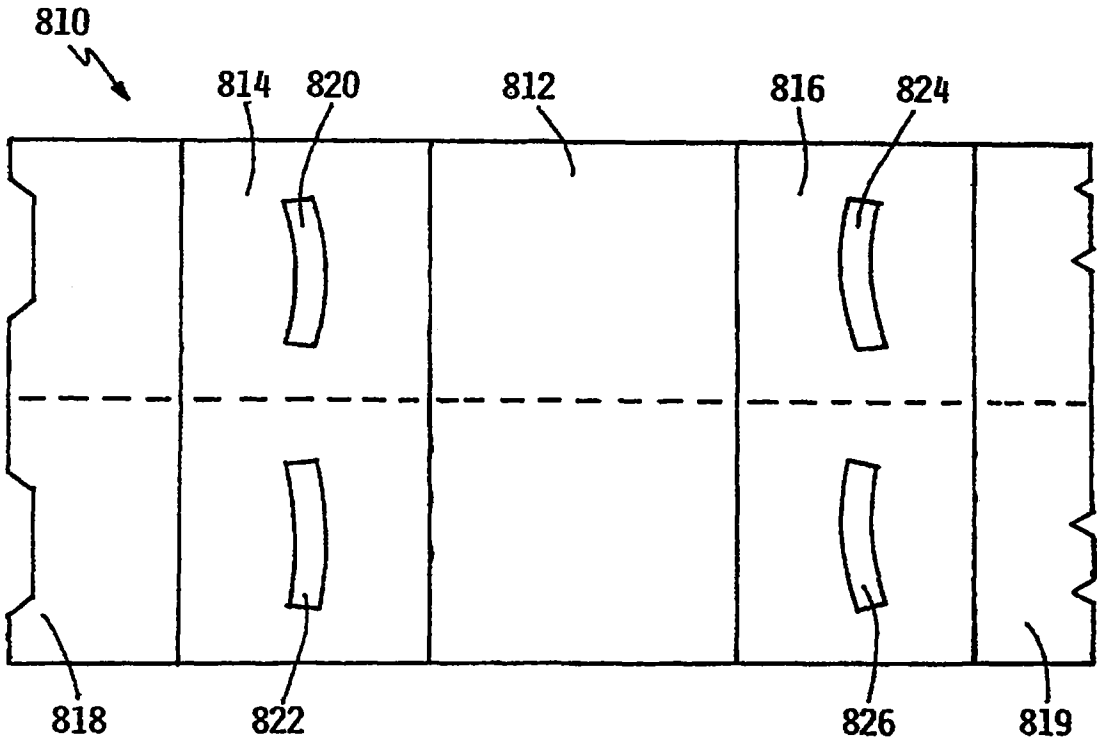
FIG. 9 shows a top plan view of a full overwrap sleeve pursuant to the invention.

FIG. 8 shows a tray assembly 800 utilizing a full wrap around sleeve 810. Sleeve 810 contains 4 trays, including container 10 and container 260. Sleeve 810 is shown in greater detail in FIG. 9. Sleeve 810 is a box-shaped container made of paperboard or a similar paper product. Sleeve 810 includes a sleeve base 812, two depending sleeve sides 814, 816, and a sleeve top 818. Apertures 820 and 822 are disposed in side 814. Apertures 824 and 826 are disposed in side 816.

Figure 12:
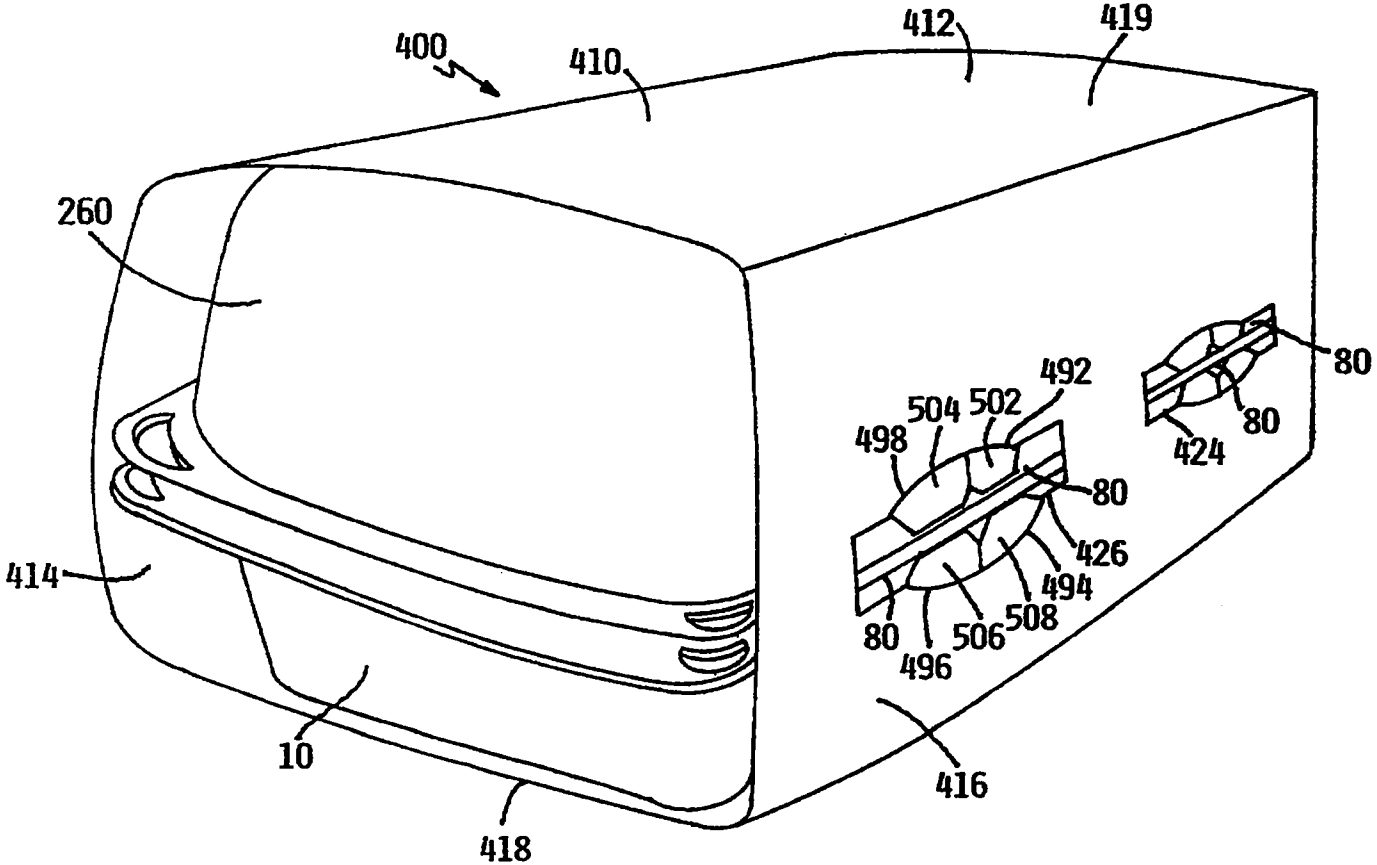
FIG. 12 shows a top plan view of an alternative embodiment of the full overwrap sleeve pursuant to the invention.
Figure 13:
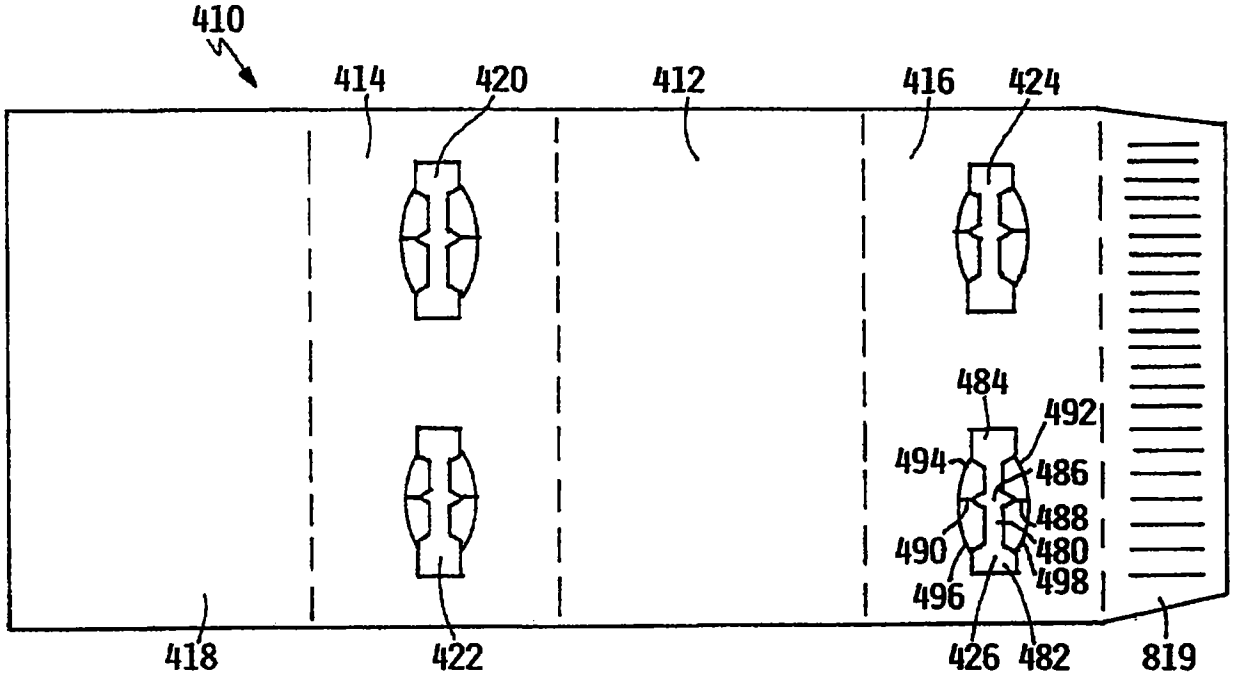
FIG. 13 shows an isometric view of another alternative embodiment of the packaging assembly pursuant to the invention incorporating an alternative embodiment of the full overwrap sleeve.

FIG. 12 shows an alternative embodiment of the tray assembly 400 utilizing an alternative embodiment of the full wrap around sleeve 410. Sleeve 410 contains 4 trays, including container 10 and container 260. Sleeve 410 is shown in greater detail in FIG. 13. Sleeve 410 is a box-shaped container made of paperboard or a similar paper product. Sleeve 410 includes a sleeve base 412, two depending sleeve sides 414, 416, and a sleeve top 418. Apertures 420 and 422 are disposed in side 414. Apertures 424 and 426 are disposed in side 416.

Apertures 420, 422, 424, and 426 generally comprise identical configurations. Therefore, the only the configuration of aperture 426 will be discussed in detail. Aperture 420 is particularly suitable for applying pressure to catch members 80 to create a frictional force that assists in holding containers 10 and 260 into sleeve 410. Aperture 426 includes a generally hourglass shape with narrow portion 480 between wide portions 482 and 484. The center of aperture 426 includes a diamond-shaped center portion 486. Slits 488 and 490 are formed in sleeve 410 on opposing sides of center portion 486. Sleeve 410 also includes crease 492 that extends from the end of slit 488 to wide portion 484, crease 494 that extends from the end of slit 490 to wide portion 484, crease 496 that extends from the end of slit 490 to wide portion 482, and crease 498 that extends from the end of slit 488 to wide portion 482. Creases 492, 494, 496, and 498 generally comprise an arc configuration facilitate deformation of sleeve 410 around aperture 426. However, creases 492, 494, 496, 498 may form a variety of patterns including straight, wavy or zigzagged while remaining within the scope of the invention.

As shown in FIG. 12, the portion of sleeve 410 between aperture 426 and crease 492 comprises flap 502. The portion of sleeve 410 between aperture 426 and crease 498 comprises flap 504. The portion of sleeve 410 between aperture 426 and crease 496 comprises flap 506. Moreover, the portion of sleeve 410 between aperture 426 and crease 494 comprises flap 508.

In a preferred embodiment, the portion of flaps 502, 504, 506, and 508 adjacent to aperture 426 push outwardly as catch members 80 of trays 10 and 260 move through aperture. Once catch members 80 are in a desired position relative to sleeve 410, flaps 502, 504, 506, 508 move back to a position that is planar with side 416.

Figure 10:
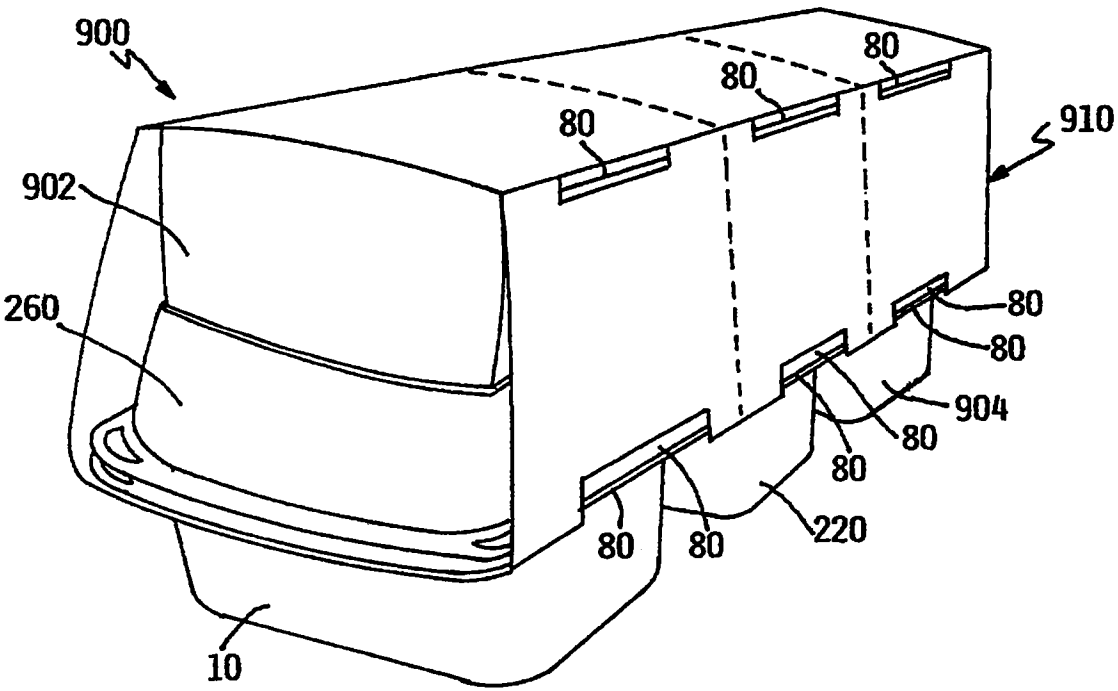
FIG. 10 shows an isometric view of an alternative embodiment of the packaging assembly pursuant to the invention.

FIG. 10 shows tray assembly 900. Sleeve 910 contains 9 trays, including containers 10, 260, 902, 220, and 904. Containers 260 and 902 are shown stacked atop container 10. Container 10 is disposed in a right-side-up configuration. Container 260 is stacked upside-down atop container 10. Container 902 is stacked right-side-up atop the bottom of container 902. Two containers are stacked above each of containers 220 and 904 in a similar fashion.

Figure 11:
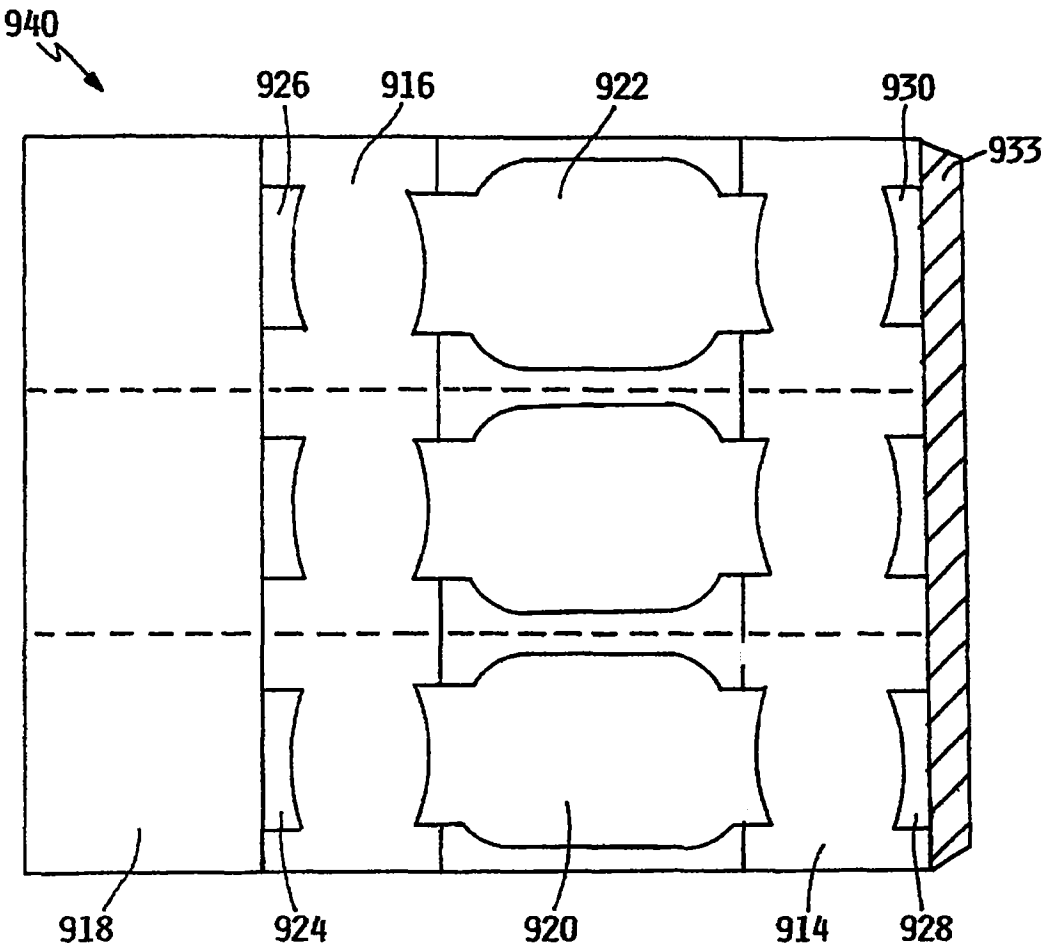
FIG. 11 shows a top plan view of an alternative embodiment of the packaging sleeve pursuant to the invention.

Sleeve 940 is shown in FIG. 11. Sleeve 910 is a box-shaped container made of paperboard or a similar paper product. Sleeve 910 includes a sleeve base 912, two depending sleeve sides 914, 916, and a sleeve top 918. Apertures 920 and 922 are disposed in base 912. Apertures 924 and 926 are disposed in side 916. Similarly, apertures 928 and 930 are disposed in side 914. Flap 933 is attached to side 914 of sleeve 910. Flap 933 may be secured to top 918 with adhesive to seal the containers in sleeve 940.

Assemblies 200 and 800 in FIGS. 6 and 8 are shown in a 2×2 tray configuration, meaning that two trays are each stacked two trays high. Assembly 900 in FIG. 10 shows a 3×3 tray configuration, meaning that three trays are each stacked three trays high. There are many variants on these configurations while remaining within the scope of the invention. For examples, tray assemblies may also include, but are not limited to, the following configurations: 1×2, 1×4, 1×6, 2×1, 2×3, 3×1, 3×2 and 3×3.

Assemblies 200, 700, 800, and 900 are used to package foods for preparation by a consumer in a microwave oven, but are not necessarily limited to foods to be microwaved. During packaging, the food distributor places food products in the various containers 10, 220, 240, and 260. A heat seal (not shown) is placed over each of the containers and is hermetically sealed to outer surface 64 to provide an air tight compartment in interior 20. Next, sealed tray 10 is placed in sleeve 100 by sliding the bottom of container 10 through opening 110 so that the lower portion of flange 16 of container 10 catch members on base 102 of the sleeve. Another container 220 is inserted into opening 112 in similar fashion. Next, container 260 is placed on top of container 10 such that flange 16 of container 10 touches flange 16 of container 260. Moreover, container 240 is placed on top of container 10 such that flange 16 of container 10 touches flange 16 of container 240. After the trays are in place, as described, panels 104 and 108 are folded together over trays 240 and 260. In this configuration, catch members 80 of containers 10 extend at least partially through ports 120 or 122 to lock the trays 10, 220, 240, and 260 in sleeve 100. Once the top panel 108 is secure against panel 212, assembly 200 is ready for distribution in the marketplace. This configuration of assembly 200 provides sufficient interference to prevent any one of containers 10, 220, 240, and 260 from inadvertently sliding out of the assembly 200 during distribution, storage, while on a store shelf, or in a consumer's home.

After assembly 200 is packed, sleeve 100 protects containers 10, 220, 240, and 260 and insures that the heat seal remains sealed to flange 16. It also helps provide a tamper-evident package that displays nutritional information, ingredients, heating directions, and other information. Sleeve 100 also safeguards the containers by acting as a protective layer during shipping and also when the tray is displayed on the shelf, freezer, refrigerator, or other display area. For this reason, sleeve top 108 is typically a continuous piece that is free of any apertures.

Once a customer purchases assembly 200, there is no need to remove the container from sleeve 100 until container 10 and its contents are ready to be cooked. After assembly 200 is purchased, the consumer places the assembly in a home pantry, freezer or refrigerator until the consumer wishes to cook the food in container 10.

When the consumer desires to prepare the food in container 10 for consumption, the consumer takes the assembly and separates it along perforation 270. Perforation 270 may include a zip strip, or other apparatus to separate assembly along line 270. Next, one container is removed from the assembly by tearing sleeve 100 or bending the sleeve to a shape in which catch members 80 can slide out of ports 120.

The container 10 and sleeve 100 of the invention provides a marked improvement over previous designs. More particularly, the container 10 is well suited for pre-made food packaging and heating applications, in that a thermoformed plastic is utilized such that overall costs are minimized. To this end, a wide variety of food items can be contained and heated within the container, including meat products, pasta products, vegetable products, combinations of meat/pasta/vegetable, desserts, grain based products and cereals, etc. Further, container 10 provides improved heat deflection at handles 18 and is essentially reinforced against torsional forces generated when the container is lifted by a single hand following heating within an oven.

Figure 14:
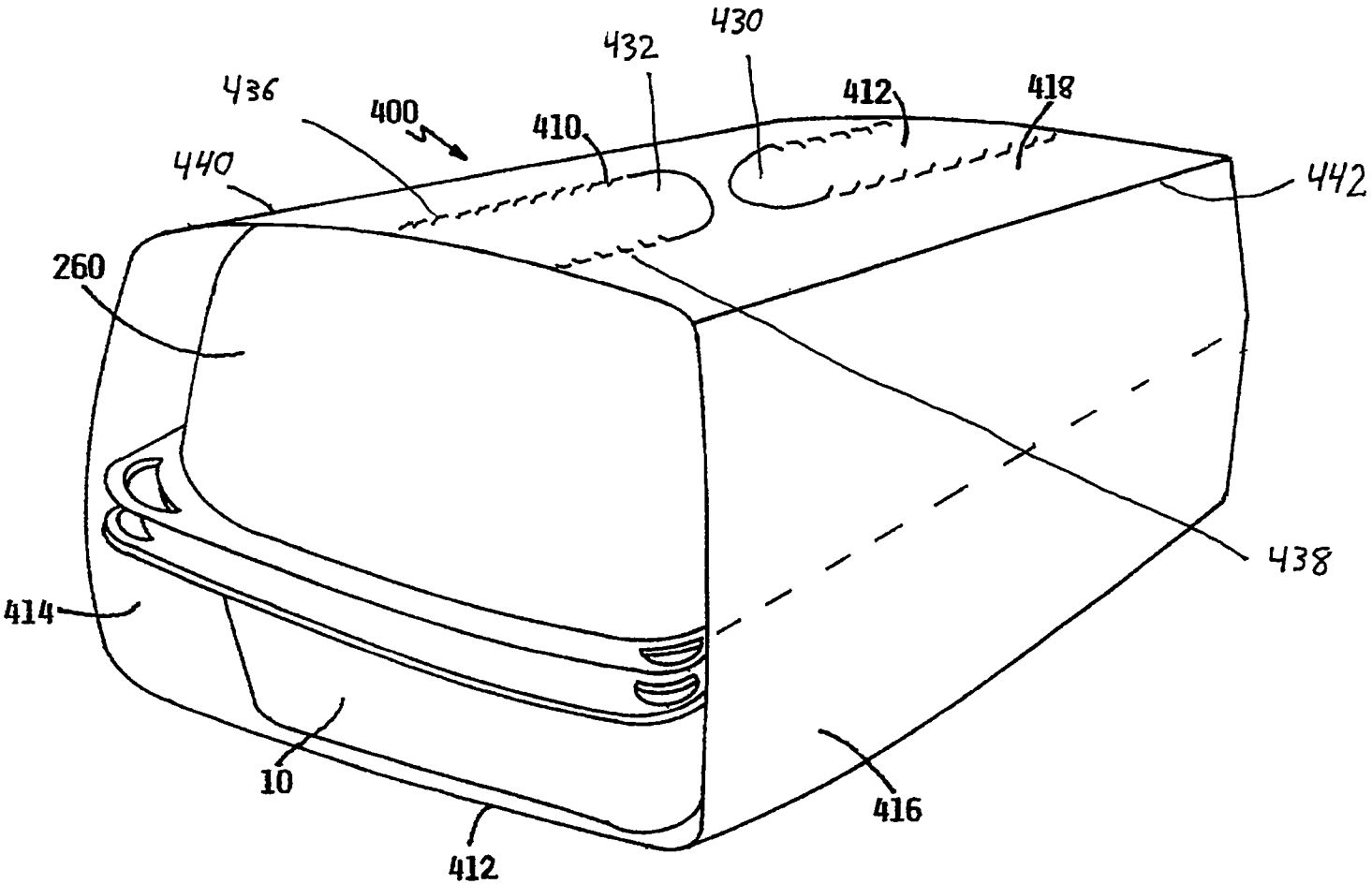
FIG. 14 shows yet another isometric view of an alternative embodiment of the packaging assembly pursuant to the invention incorporating another alternative embodiment of the full overwrap sleeve with opening feature.

FIG. 14 shows an alternative embodiment of the tray assembly 400 utilizing an alternative embodiment of the full wrap around sleeve 410. Sleeve 410 contains 4 trays, including container 10 and container 260. Sleeve 410 is shown in greater detail in FIG. 16. Sleeve 410 is a box-shaped container made of paperboard or a similar paper product. Sleeve 410 includes a sleeve base 412, two depending sleeve sides 414, 416, and a sleeve top 418. In contrast to the sleeve shown in FIG. 12, sides 414 and 416 do not include apertures. This configuration can be desirable for utilizing frictional force to keep containers inside sleeve 410.

Figure 16:
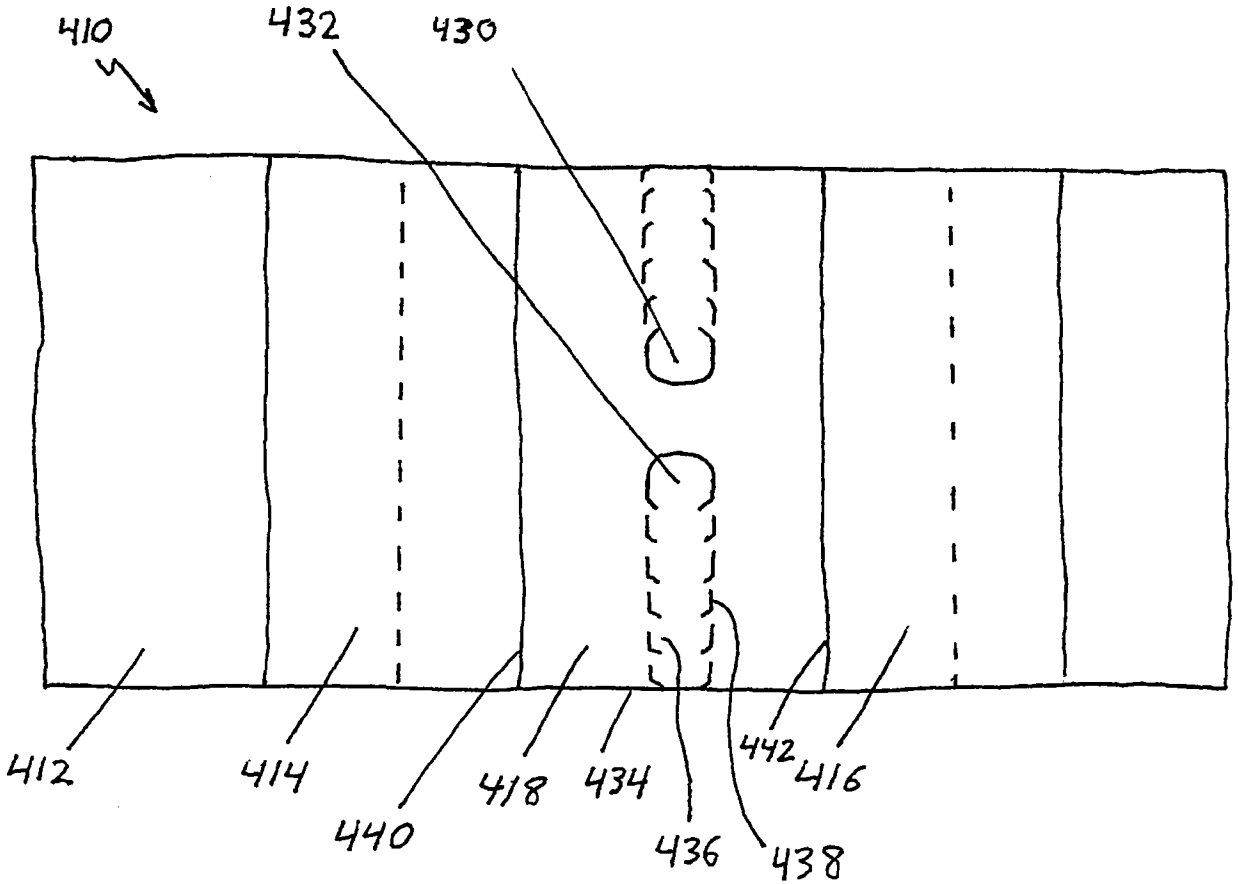
FIG. 16 shows a top view of an alternative embodiment of a full wrap around sleeve pursuant to the invention.

With reference to FIG. 16, opening tabs 430 and 432 are disposed in sleeve top 418 to facilitate removal of containers from sleeve 410. Tabs 430 and 432 may be mechanically or laser scored in sleeve top 418, and may comprise a wide variety of configurations while remaining within the scope of the invention.

The general operation of tabs 430 and 432 will be discussed with reference to tab 432, although tab 430 functions in a similar fashion. For example, to remove container 260 from assembly 400, a user pulls on tab 432 to remove tab 432 from the general plane containing sleeve top 418. User then pulls tab 432 in a direction toward side 434 causing sleeve top 418 to tear along perforation lines 436 and 438. When tab 432 is completely separated from sleeve top 418, the distance between margins 440 and 442 increases. The increased distance between margins 440 and 442 reduces the frictional force holding container 260 inside sleeve 410 and enables a user to remove container 260 from sleeve 410 relatively easily.

Figure 15:
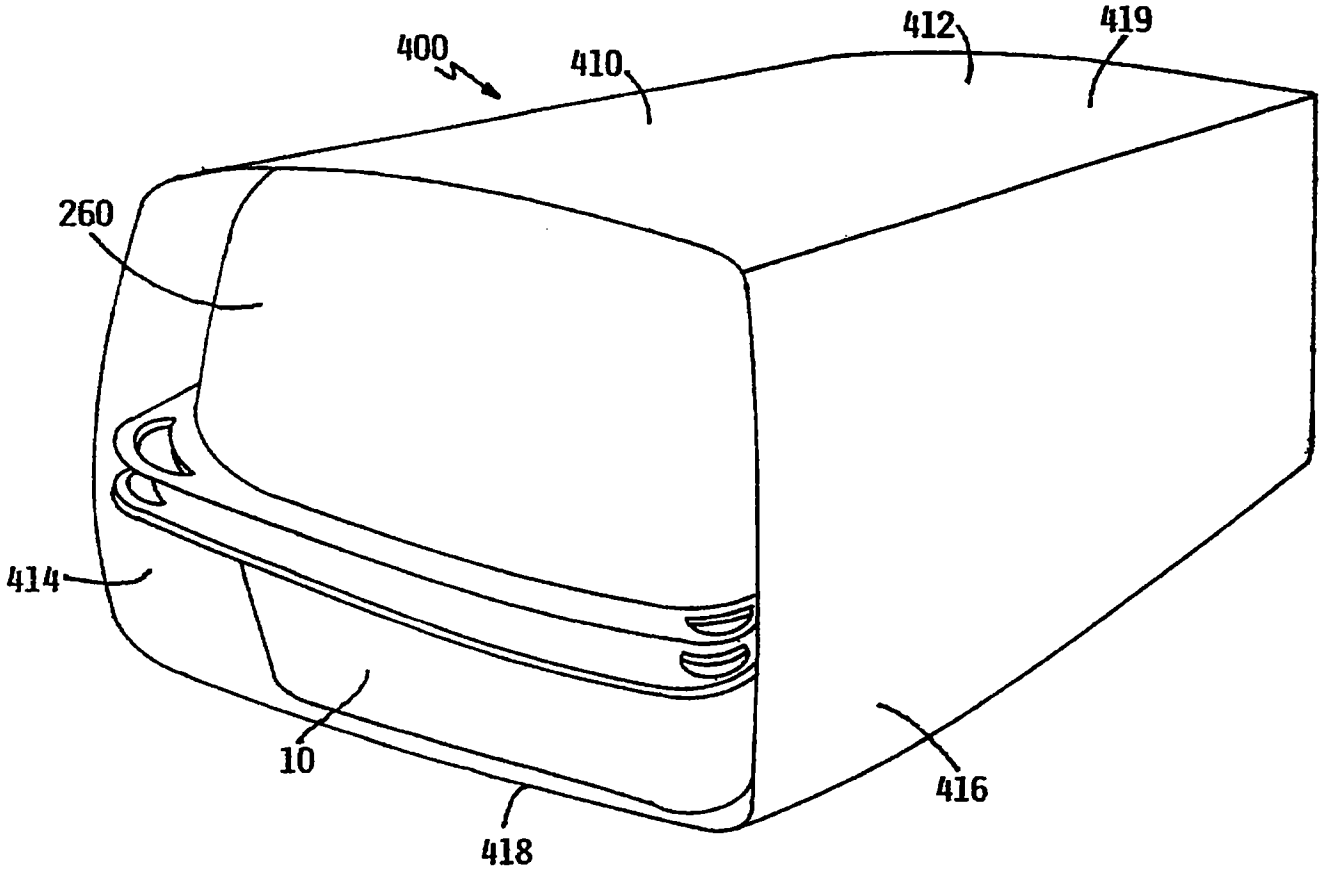
FIG. 15 shows another isometric view of an alternative embodiment of the packaging assembly pursuant to the invention incorporating an alternative embodiment of the full overwrap sleeve.

The individual scores that are shown to make up perforation lines 436 and 438 include a portion that is parallel to margins 440 and 442 and a portion that is inwardly skewed relative to margins 440 and 442. This configuration is desirable for directing and controlling the tear of sleeve top 418 between lines 436 and 438. It is important to note, however, that lines 436 and 438 can comprise a wide variety of configurations relative to one another. For example, lines 436 and 438 may be parallel to or skewed relative to one another or margins 440 and 442. Alternatively, sleeve 410 may be fabricated without tabs 430, 432, and lines 436, 438 as shown in FIG. 15.

Tabs 430 and 432 are shown to comprise a generally half-circular configuration. It is important to recognize, however, that tabs 430 and 432 may comprise a variety of configurations while remaining within the scope of the invention, including, but not limited to oval, polygonal, or irregularly shaped.

Although the invention has been described with reference to preferred embodiments, those of ordinary skill in the art will recognize that changes can be made in form and detail without departing from the spirit and scope of the invention.

What is claimed is:

1. A food package kit comprising:

a first tray, a second tray, a third tray, and a fourth tray, each tray adapted to contain a food item, each tray including a bottom, a sidewall extending upwardly from the bottom and terminating at a top end, the sidewall including structure defining a collar extending radially outwardly therefrom, and a stacking wall extending upwardly from the collar and terminating at the top end of the sidewall, wherein the collar and stacking wall inhibits any of the other trays from entirely nesting within the tray, a flange extending from the sidewall opposite the bottom, the flange including a rim section configured to receive a sealing film, a recessed section extending from the rim section, the recessed section terminating in a pair of opposed lateral edges and a pair of opposed longitudinal edges, wherein each of the opposed longitudinal edges intersect with a lateral edge at a corner, wherein each corner contains a handle, and at least one catch member extending outwardly from the flange and disposed between the handles on each of the lateral edges, wherein the flange and the collar define compound curves such that deflection or bending of the tray due to a weight of the food item is inhibited when the tray is lifted; and a sleeve adapted to hold the first tray and the second tray therein such that the rim section of the first tray and the rim section of the second tray are each between the bottom of the first tray and the bottom of the second tray, and to hold the third tray and the fourth tray therein such that the rim section of the third tray and the rim section of the fourth tray are each between the bottom of the third tray and the bottom of the fourth tray, the sleeve including a sleeve top, a sleeve base, a first sleeve side and a second sleeve side, wherein each of the at least one catch members is adapted to engage the sleeve to releasably retain the corresponding tray within the sleeve.

2. The food kit of claim 1 wherein the first sleeve side contains a first aperture for the catch members of the first tray and the second tray, and a second aperture for the catch members of the third tray and the fourth tray.

3. The food kit of claim 1 wherein the second sleeve side contains a third aperture for the catch members of the first tray and the second tray and a fourth aperture for the catch members of the third tray and the fourth tray.

4. The food kit of claim I wherein the sleeve further includes a perforation line disposed to divide the sleeve into a first sleeve half for the first tray and the second tray and a second sleeve half for the third tray and the fourth tray.

5. A container for use in microwave heating and adapted to contain a food item, the container comprising:

a bottom;

a sidewall extending upwardly from the bottom and terminating at a top end, the sidewall including structure defining a collar extending radially outwardly therefrom, and a stacking wall extending upwardly from the collar and terminating at the top end of the sidewall, wherein the collar and stacking wall inhibits another tray from entirely nesting within the container; and a flange extending from the sidewall opposite the bottom, the flange including a rim section adapted to receive a sealing film, and a recessed section including a plurality of handles, and a pair of catch members located between the plurality of handles, the catch members extending radially outwardly from the flange on opposed sides of the container for engaging a sleeve to releasably retain the container within the sleeve, wherein the flange and the collar define compound curves such that deflection or bending of the tray due to a weight of the food item is inhibited when the tray is lifted.

6. The container of claim 5, wherein the sidewall includes a base section, an intermediate section, and an upper section, the upper section including the collar and the stacking wall.

7. The container of claim 6, wherein the base section defines a transverse, cross-sectional radius of from about 0.25 to about 1.0 inches.

8. The container of claim 6, wherein the intermediate section is linear in transverse cross-section.

9. The container of claim 8, wherein the intermediate section defines an angle relative to the horizontal plane of from about 70 to about 89 degrees.

10. The container of claim 5, wherein the recessed section includes two opposed linear edges.

11. The container of claim 5, wherein each of the handles includes a grip that defines a plane that is lower than a plane defined by a surface of the rim section.

12. The container of claim 5, wherein the recessed section includes a pair of opposed lateral sides and a pair of opposed longitudinal sides, a union of a lateral side and a longitudinal side defining a corner wherein each of the plurality of catch members radially extend from the lateral sides.

13. The container of claim 12, wherein a handle is located at each of the corners.

* * * * *